US007801466B2

(12) United States Patent
Hirose

(10) Patent No.: US 7,801,466 B2
(45) Date of Patent: Sep. 21, 2010

(54) DEVELOPING DEVICE AND IMAGE FORMING APPARATUS

(75) Inventor: Hiroya Hirose, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 277 days.

(21) Appl. No.: 11/750,746

(22) Filed: May 18, 2007

(65) Prior Publication Data

US 2007/0269235 A1 Nov. 22, 2007

(30) Foreign Application Priority Data

May 19, 2006 (JP) ..... 2006-140659
Jan. 30, 2007 (JP) ..... 2007-020163

(51) Int. Cl.
*G03G 15/08* (2006.01)

(52) U.S. Cl. ..... 399/256; 399/99; 399/119

(58) Field of Classification Search ..... 399/99, 399/119, 254, 256–260, 360
See application file for complete search history.

(56) References Cited

U.S. PATENT DOCUMENTS

| | | | | |
|---|---|---|---|---|
| 2,761,416 | A * | 9/1956 | Carlson | 399/164 |
| 5,109,254 | A | 4/1992 | Oka et al. | |
| 5,508,794 | A * | 4/1996 | Ikesue et al. | 399/120 |
| 5,657,115 | A * | 8/1997 | Sugihara | 399/263 |
| 7,110,696 | B2 | 9/2006 | Murakami et al. | |
| 2006/0216085 | A1 | 9/2006 | Murakami et al. | |

FOREIGN PATENT DOCUMENTS

| | | |
|---|---|---|
| JP | 2-21591 | 5/1990 |
| JP | 2-73659 | 6/1990 |
| JP | 8-22190 | 1/1996 |
| JP | 2000-267420 | 9/2000 |
| JP | 2000-321872 | 11/2000 |
| JP | 2001-265098 | 9/2001 |
| JP | 2001-290368 | 10/2001 |
| JP | 3324388 | 7/2002 |
| JP | 2003-15421 | 1/2003 |
| JP | 2005-99134 | 4/2005 |
| JP | 2006-215331 | 8/2006 |
| JP | 2006-251512 | 9/2006 |

OTHER PUBLICATIONS

U.S. Appl. No. 12/015,803, filed Jan. 17, 2008, Hirose.
U.S. Appl. No. 11/612,865, filed Dec. 19, 2006, Tsuda, et al.
U.S. Appl. No. 11/748,533, filed May 15, 2007, Yoshida, et al.

* cited by examiner

*Primary Examiner*—David P Porta
*Assistant Examiner*—Benjamin Schmitt
(74) *Attorney, Agent, or Firm*—Oblon, Spivak, McClelland, Maier & Neustadt, L.L.P.

(57) ABSTRACT

A developing device includes a container, a stirring and transferring unit, a replenishing unit, and a discharging mechanism. The container contains developer including toner and carrier. The stirring and transferring unit is located in the container to mix and stir the toner and the carrier, and circulates the developer in the container. The replenishing unit replenishes the container with developer from an opening of the container. The discharging mechanism discharges surplus developer out of the container, and is located on a rotation shaft of the stirring and transferring unit.

18 Claims, 18 Drawing Sheets

DEVELOPING DEVICE AND IMAGE FORMING APPARATUS

CROSS-REFERENCE TO RELATED APPLICATIONS

The present document incorporates by reference the entire contents of Japanese priority documents, 2006-140659 filed in Japan on May 19, 2006, 2007-020163 filed in Japan on Jan. 30, 2007.

BACKGROUND OF THE INVENTION

1. Field of the Invention

The present invention relates to a developing device, and an image forming apparatus.

2. Description of the Related Art

In an electrophotographic image forming apparatus such as a copier, a laser printer, and a facsimile machine, a process is performed of developing the electrostatic latent image formed on the latent image carrier (photosensitive drum) with the toner supplied from the developing device to form a toner image, transferring the toner image onto transfer sheet, and fixing the toner image.

Many conventional image forming apparatus using a dry developer including a toner and a carrier employ a developing device having a developer carrier (developing roller) that visualizes electrostatic latent images on a surface of the latent image carrier.

In the developing device, the toner is consumed by a developing operation, while the carrier is not consumed and remains in the developing device. Therefore, in the carrier stirred with the toner in the developing device, peeling of a resin coat layer on a carrier surface and adhesion of the toner onto the carrier surface occur, as stirring frequency increases. These phenomena cause contamination and progress of deterioration, thereby decreasing charging performance of the carrier.

Because the charging performance of the carrier as the developer gradually decreases, toners that do not hold an electric charge for charging is generated, and an image quality defect such as background stain of a print occurs, which is a phenomenon in which the toner adheres on a non-image portion on the photosensitive drum at the time of development, thereby causing considerable degradation of image quality.

To prevent the image quality defect such as the background stain resulting from deterioration of the carrier, the deteriorated developer in a developer container needs to be replaced regularly, and considerable maintenance labor has been consumed to replace the developer.

For example, to eliminate the need to replace developer, Japanese Patent Application Publication No. H2-21591 has proposed a developing device that replenishes a developer container with a small amount of developer including a mixture of carrier and toner into at the time of a normal operation for adding and replenishing the toner consumed due to a developing operation, and discharges deteriorated developer having deteriorated charging performance in a small amount from the developer container, thereby suppressing a decrease in the charging performance. This type of technique has been conventionally known as a "trickle developing method".

According to the trickle developing method, the volume of a developer in a developer container increases due to replenishment of new carrier together with new toner into the developer container. However, the surplus carrier is allowed to overflow and discharged from a developer discharge port provided on a wall of the developer container, and collected in a developer collecting container.

By repeating replenishment and discharge of the carrier and the deteriorated developer, the developer contaminated and deteriorating in the developer container is replaced by newly supplied toner and carrier. Thus, the charging performance of the developer and the image quality are maintained.

In Japanese Patent Application Laid-open No. 2005-99134, a transfer member that stirs and transfers a developer including a toner and a carrier is formed of a first transfer unit having greater carrier capability and a second transfer unit having lesser carrier capability, and a discharge port is provided opposite to the second transfer unit. This configuration is for solving a problem such that a discharge amount of the surplus developer varies in a situation where vibration and impact are likely to occur in the developing device, which are generated at the time of rotating a developing unit in a revolving-type color developing device in which respective developing units storing each color toner rotate and move to a developing position, or at the time of supplying a recording sheet to a sheet feeder. Because a height of an upper surface of the developer largely varies vertically near a member such as a screw that stirs and transfers the developer, the upper surface position of the developer cannot be stably maintained relative to the discharge port, whose height is fixed. However, near the second transfer unit having lesser transfer capability, the height of the developer does not largely vary. Accordingly, the discharge port is set at the position, so that the developer in the developing device is maintained stably to stabilize the image quality.

In this case, however, because the developer discharge port provided on the wall of the developer container is fixedly arranged, if the developer adheres to the inside of the discharge port, an opening area becomes narrower, and the developer cannot be allowed to overflow and discharged stably from the developer container.

In Japanese Patent Application Laid-open No. H8-22190, to solve a problem such that when an opening for discharging a surplus developer is located on a wall of a developer container, the developer and the toner are accumulated in and adheres to a discharge port, whose position is fixed, to narrow the opening area, and the developer cannot be discharged from the developer container stably, and sequential replacement of the developer cannot be appropriately performed, an overflow unit is provided on the developer container side prior to the discharge port, so that the overflow unit blocks the developer transferred by the stirring unit to allow the developer to overflow in a predetermined amount from above the stirring unit is provided. The developer discharged from the overflow unit can be discharged by a transfer unit exclusive for discharge, and the discharge port can be arranged not only a side wall but also on the bottom of the developer container. Accordingly, the developer can be discharged without blocking the discharge port, and the developer amount discharged from the discharge port can be easily adjusted, thereby enabling appropriate sequential replacement of the developer.

However, it is configured such that the developer directed from a collection port to the discharge port is transferred in a backward direction flowing to the collection port, that is, to the developer container. Therefore, the developer is present in a dense state from the collection port of a return screw blade to the vicinity of the discharge port, which causes a problem such that rotating torque of the screw blade considerably increases. Although it is aimed to suppress the discharge amount by the return screw blade, the increase in torque accompanying this generates heat in the developer and causes deterioration of the carrier due to a thermal stress, thereby causing a decrease in stability of the image quality.

SUMMARY OF THE INVENTION

It is an object of the present invention to at least partially solve the problems in the conventional technology.

According to an aspect of the present invention, a developing device includes a container that contains developer including toner and carrier, and includes a first opening and a second opening, a developer carrier that is rotatably supported to face an image carrier via the first opening of the container, and carries the developer, a stirring and transferring unit that is located in the container to mix and stir the toner and the carrier, and circulates the developer in the container, a replenishing unit that replenishes the container with developer from the second opening, and a discharging mechanism that discharges surplus developer out of the container, and is located on a rotation shaft of the stirring and transferring unit.

According to another aspect of the present invention, a developing device includes a container that contains developer including toner and carrier, and includes a first opening, a second opening, a third opening, and a fourth opening, a developer carrier that is rotatably supported to face an image carrier via the first opening of the container, and carries the developer, a developer supply unit that supplies the developer to the developer carrier;

a stirring and transferring unit that is located in the container to mix and stir the toner and the carrier, and circulates the developer in the container, a developer collecting unit that collects developer separating from the developer carrier after a necessary amount of developer is supplied to the image carrier from the developer regulated on the developer carrier, a replenishing unit that replenishes the container with new developer containing carrier from the second opening, and a discharging mechanism that discharges surplus developer out of the container, and is located on a rotation shaft of the developer supply unit. The third opening allows a circulation path of the stirring and transferring unit to communicate with the developer supply unit. The fourth opening allows the circulation path to communicate with the developer collecting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1A:
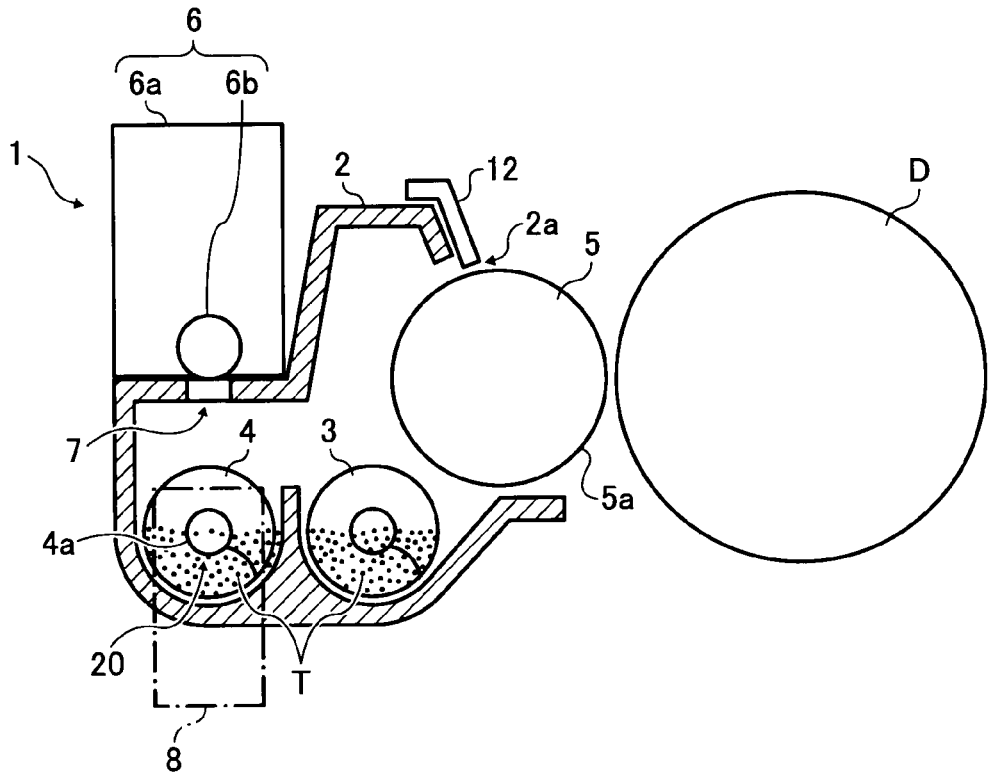
FIG. 1A is a schematic diagram of an image forming unit in an electrophotographic image forming apparatus including a developing device according to an embodiment of the present invention.
Figure 1B:
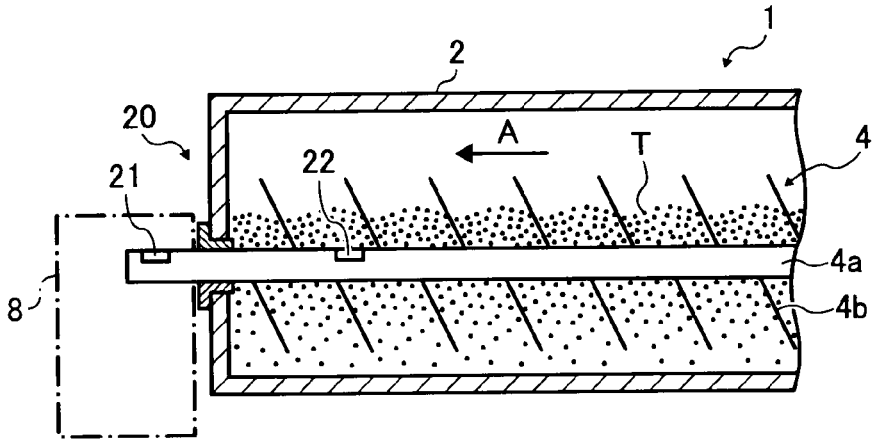
FIG. 1B is a longitudinal sectional view of a developer container shown in FIG. 1A.
Figure 1C:
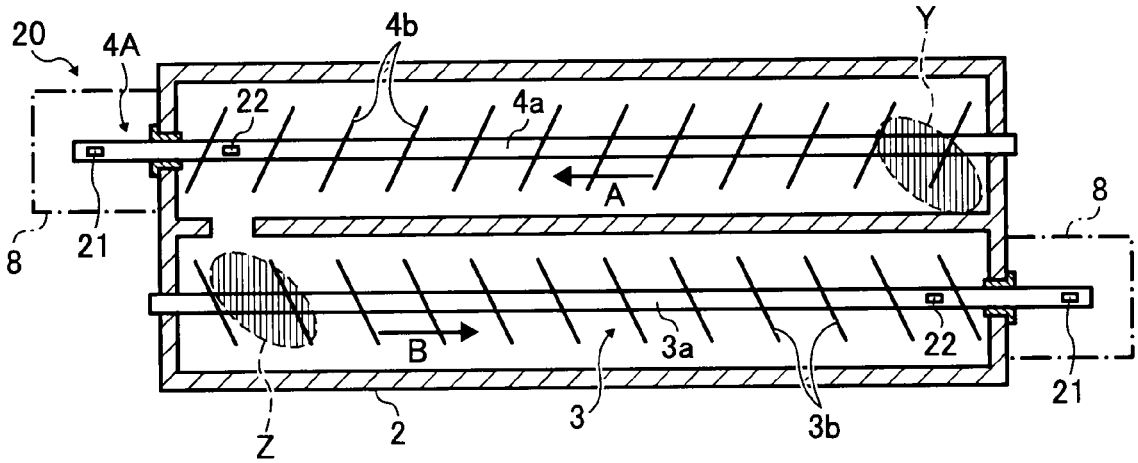
FIG. 1C is a cross sectional view of the developer container.

FIG. 1A is a schematic diagram of an image forming unit in an electrophotographic image forming apparatus (copier, laser printer, and the like) including a developing device 1 and a photosensitive drum (latent image carrier) D according to an embodiment of the present invention. FIGS. 1B and 1C are a longitudinal sectional view and a cross sectional view of a developer container 2.

A surface of the rotatable photosensitive drum (latent image carrier) D is uniformly charged by a charger (not shown), and image data corresponding to an original data read by an image reader (not shown) or image data transmitted from a host personal computer (PC) is written thereon by laser beams from a laser writing unit (not shown). Thus, an electrostatic latent image is formed on the surface of the photosensitive drum D.

The developing device 1 uniformly supplies the toner to the photosensitive drum D to visualize the electrostatic latent image. The developing device 1 includes the developer container 2 that contains a developer T including the toner and the carrier, a screw (developer supply unit, stirring and transferring unit) 3 arranged in the developer container 2 and rotating to supply the developer to a developing roller 5, a screw (stirring and transferring unit) 4 arranged in the developer container 2 and rotating to stir, circulate, and transfer the developer, the developing roller (developer carrier) 5 arranged opposite to the latent image carrier via an opening 2*a* provided in the developer container 2 and rotatably supported, the developer replenishing unit 6 (a toner cartridge 6*a* and a replenishing roller 6*b*) that additionally replenishes a new developer including the carrier to the developer container 2 via a replenishing opening 7 provided in the developer container, and a surplus developer discharging mechanism 20 provided for discharging the surplus developer to the outside of the developer container.

The developing roller 5 is formed of a rotatable developing sleeve 5*a* arranged and set opposite to a peripheral face of the photosensitive drum D and a magnetic body having a magnetic pole (not shown) fixedly arranged in the developing sleeve 5*a*. The magnetic body in the developing roller 5 is required for holding the developer on the surface of the developing sleeve 5*a*, and a doctor blade 12 regulates the developer amount to be held on the surface of the developing sleeve to a proper amount. The doctor blade 12 is normally formed in a plate shape of stainless steel or the like, and is set to be away from the surface of the developing sleeve by about 0.2 millimeter to 1.2 millimeters, so that a developer layer is formed on the developing sleeve 5*a* in a uniform thin layer to supply the developer uniformly to the electrostatic latent image on the photosensitive drum D.

The screw (stirring and transferring unit) 3 includes a rotation shaft 3*a* rotatably and axially supported by the developer container 2 and rotated by a driving source, and a screw blade 3*b* spirally provided in a protruding condition on an outer circumference of the rotation shaft 3*a*.

The screw (stirring and transferring unit) 4 includes a rotation shaft 4*a* rotatably and axially supported by the developer container 2 and rotated by the driving source, and a screw blade 4*b* spirally provided in a protruding condition on an outer circumference of the rotation shaft 4*a*.

A salient feature of the embodiment is that the surplus developer discharging mechanism 20 is provided on the rotation shaft 3*a* or the rotation shaft 4*a* of the screw (stirring and transferring unit) 3 or 4. In the embodiment, a configuration in which the surplus developer discharging mechanism 20 is provided on the rotation shaft 4*a* of the screw 4 is mainly explained as an example.

The developer T is in a state of being filled in the developer container 2 in a predetermined amount. The developer supply unit 3 that supplies the developer to the vicinity of the developing sleeve 5*a* and the doctor blade 12 can be, for example, in a paddle shape capable of supplying the developer by pushing up or splashing. In this example, however, the developer supply unit 3 has a screw shape also having a transfer function in a horizontal direction.

The screw 4 stirs and transfers the developer T in a direction opposite to a transfer direction of the screw 3 having a function of supplying the developer T to the developing roller 5 while stirring and transferring the developer T. Both the screws 3 and 4 are rotatably arranged, and the developer T stirred and transferred by the screws 3 and 4 is moved and circulated in directions shown by arrows A and B in the developer container 2.

As a process of replenishing the new developer into the developer container, the developer in an appropriate amount is replenished from the replenishing opening 7 to the developer container 2 by the developer replenishing unit 6, with a replenishment amount being controlled. A discharge port 21 for discharging the developer T, which becomes surplus due to the replenishment of the new developer, is arranged outside of the developer container, at a shaft end 4A of the rotation shaft 4*a* of the screw 4. The surplus developer discharged from the discharge port 21 is directly collected in a collecting container 8, or is carried to the collecting container 8 by a separate transfer unit and collected therein.

Figure 2:
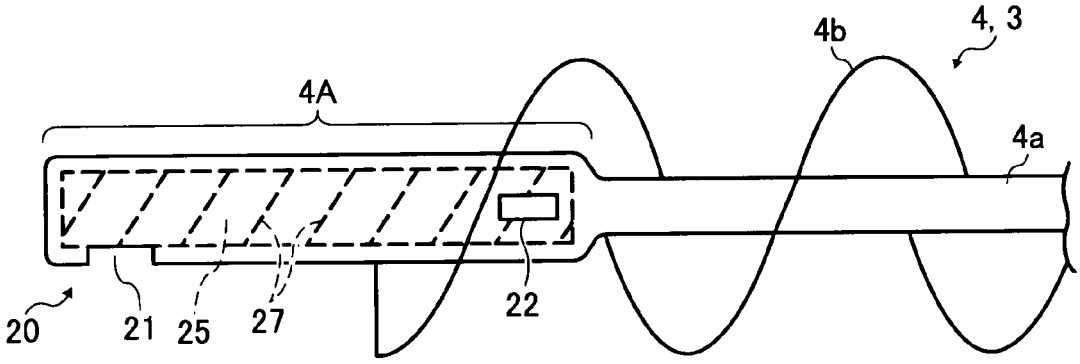
FIG. 2 is an example configuration of a surplus developer discharging mechanism shown in FIG. 1B.

FIG. 2 is an example configuration of the surplus developer discharging mechanism 20. The surplus developer discharging mechanism 20 is provided at the shaft end 4A of the rotation shaft 4*a* of the screw (stirring and transferring unit) 4.

The surplus developer discharging mechanism 20 includes a hollow portion 25 provided in a part (the shaft end 4A) of the rotation shaft 4*a* of the screw 4, and the hollow portion 25 constitutes a discharge route of the surplus developer. The rotation shaft 4*a* includes a collection port 22 for collecting the surplus developer in the developer container 2 in the hollow portion 25, and the discharge port 21 for discharging the developer collected in the hollow portion to the outside of the developer container. In this example, the shaft end 4A of the rotation shaft 4*a* is formed to have a large diameter, and the hollow portion 25 is provided inside the large-diameter shaft end 4A, and the discharge port 21 is provided at the shaft end 4A of the rotation shaft 4*a* protruding to the outside of the developer container. The collection port 22 is positioned inside of the developer container.

Figure 3A:
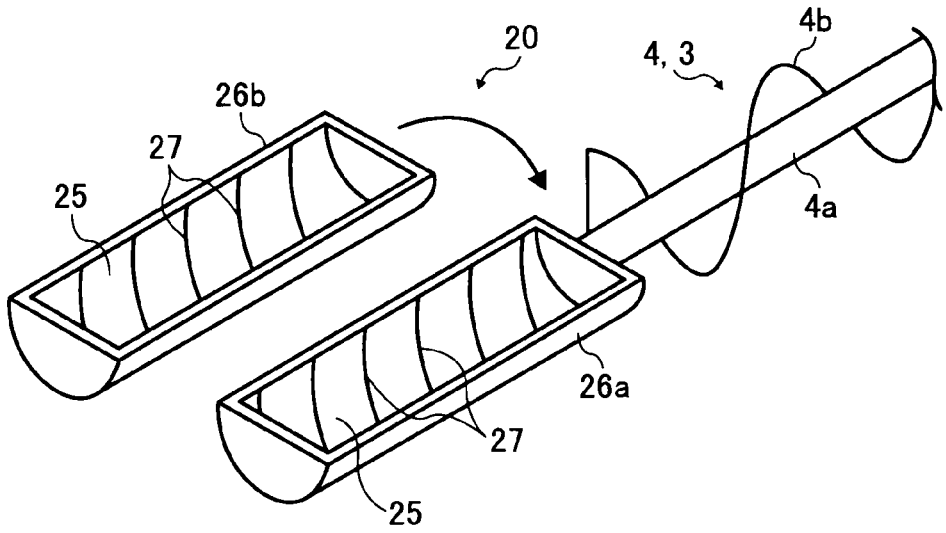
FIG. 3A is an exploded perspective view of the surplus developer discharging mechanism.
Figure 3B:
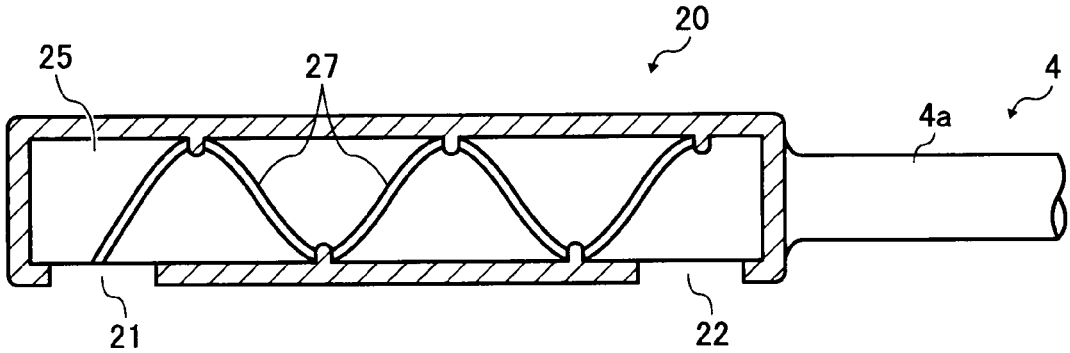
FIG. 3B is a longitudinal sectional view of the surplus developer discharging mechanism.

FIG. 3A is an exploded perspective view of the surplus developer discharging mechanism 20. FIG. 3B is a longitudinal sectional view in which the shaft end 4A of the rotation shaft 4*a* including the hollow portion 25 is divided into two by a parting line extending along an axial direction. A discharging member 27 of the surplus developer is provided on an inner wall of the hollow portion 25, according to need. The discharging member 27 is a protruding transfer unit, for example, having a spiral protruding shape. The discharging member 27 is not essential, and the configuration can be such that only the hollow portion 25, the collection port 22, and the discharge port 21 are provided.

In this example, one part 26*a* constituting the shaft end 4A has a semicylindrical shape with a bottom, and is formed of a resin or the like integrally moldable with the screw 4. Another part 26*b* has a semicylindrical shape with a bottom, with an opening end face thereof being joined with an opening end face of the part 26*a*. By combining both the parts, a cylindrical body including the hollow portion 25 and the discharging member 27 as shown in FIG. 2 is realized. A spiral direction of a spiral protrusion constituting the discharging member 27 is so set that the surplus developer introduced into the hollow portion is transferred toward the discharge port 21 side when the screw 4 rotates in a discharge direction.

The discharging member 27 can be formed by setting a convex rib beforehand on the inner wall of each part when the semicylindrical parts 26*a* and 26*b* are formed of a resin or the like, or by putting a spring metal spiral therein afterwards separately from the parts constituting the hollow portion, and has a shape such that the developer is transferred while rolling due to the rotation.

The body (4*a*, 4*b*) of the screw 4 can be a separate part from the shaft end 4A constituting the hollow portion 25. In this case, however, the shaft end 4A including the hollow portion and the rotation shaft 4*a* of the screw should be connected to each other firmly.

The collection port 22 and the discharge port 21 are respectively provided on the shaft end 4A including the hollow portion 25. The collection port and the discharge port can be formed initially on the shaft end 4A, or can be provided by additional processing after forming the hollow portion. The positions in the peripheral direction of the collection port 22 and the discharge port 21 on the shaft end 4A can be shifted by a necessary angle (for example, 90 degrees) as shown in the drawing, or can be formed at the same peripheral position.

Figure 4:
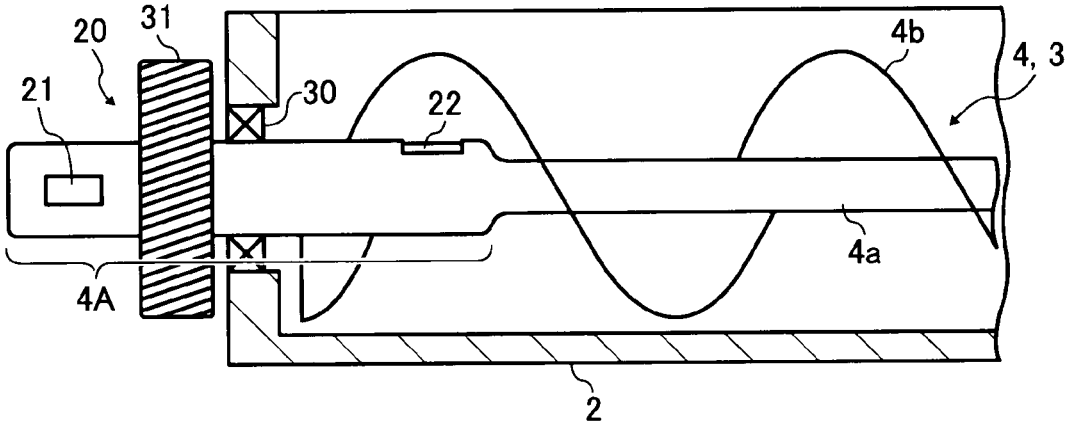
FIG. 4 is an example of a screw (stirring and transferring unit) including the surplus developer discharging mechanism that is rotatably and axially supported by a developer container.

FIG. 4 is an example of the screw (stirring and transferring unit) 4 including the surplus developer discharging mechanism 20 that is rotatably and axially supported by the developer container 2. A bearing 30 is arranged in a shaft hole provided on a wall of the developer container 2, and the shaft end 4A of the rotation shaft 4*a* is rotatably and axially supported by the bearing 30. A drive gear (driving unit) 31, to which a driving force of a driving source such as a motor (not shown) is transmitted, is integrally formed with the shaft end 4A. The drive gear 31 is fixed on an outer circumference of the shaft end 4A including the hollow portion 25.

The drive gear 31 is arranged to cover the hollow portion 25 for discharging the surplus developer. This brings a large advantage in that a space required for discharge need not be set separately, thereby keeping the developing device small.

When the screw 4 (3) rotates due to rotation of the drive gear 31, the collection port 22 and the discharge port 21 rotate integrally. The surplus developer is transferred from the collection port 22 to the discharge port 21 via the hollow portion 25 due to a rotation force of the screw 4. Effective transfer can be realized by providing, for example as shown in FIG. 3, the discharging member (spiral) 27 for transferring the developer entering into the hollow portion.

Figure 5:
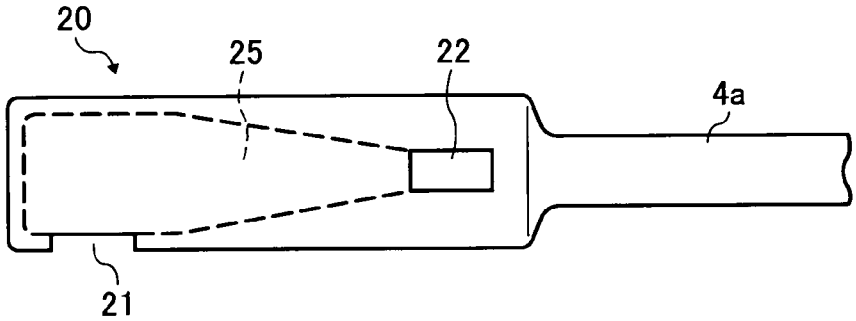
FIG. 5 is an example of a discharging member that constitutes the surplus developer discharging mechanism.

FIG. 5 is an example of the discharging member 27 that constitutes the surplus developer discharging mechanism 20. The discharging member 27 is a tapered transfer route extending from the collection port 22 to the discharge port 21.

Thus, when the shape of the discharging member 27 from the collection port 22 to the discharge port 21 is tapered and the hollow portion 25 has a gradually increasing inner diameter, the developer charged from the collection port 22 can be discharged from the discharge port 21 in a rolled manner due to gravity and the rotation force. By having such a shape, the number of component parts can be reduced, and the shape of the component parts can be simplified, thereby realizing cost reduction.

Figure 6:
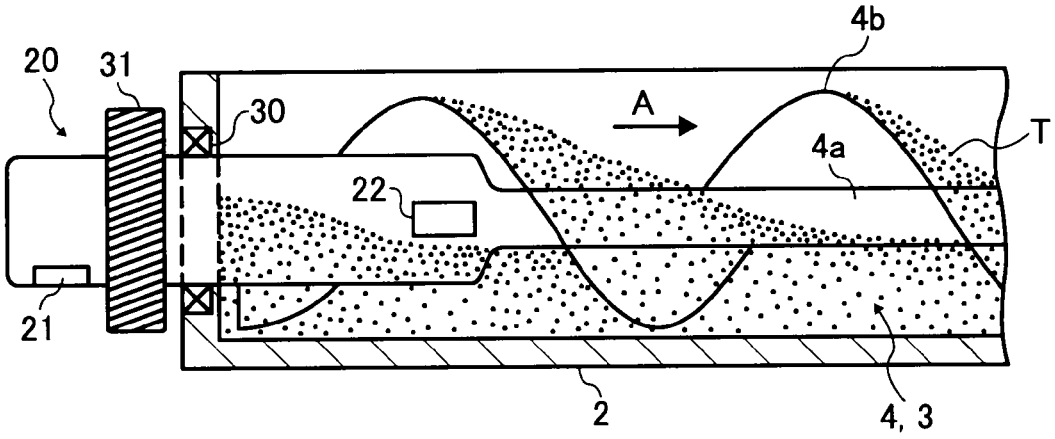
FIG. 6 is a schematic diagram for explaining movement of developer discharged through the surplus developer discharging mechanism.

FIG. 6 is a schematic diagram for explaining movement of developer discharged through the surplus developer discharging mechanism 20.

In the developer container 2, if an upper face position of the developer T is always higher than the collection port 22 in the developer discharging hollow portion 25, the developer always flows in from the collection port 22 and collected, and it is assumed that the discharge amount from the discharge port 21 is fixed. In this case, therefore, it is desired that the developer height is set lower than the discharge port 21, and an outer diameter of the screw 4 (3) needs to be increased or a charge of the developer needs to be set smaller.

However, if the charge of the developer to be used for development becomes small, service life of the carrier becomes particularly short. Therefore, frequent replacement is required, and with the method of mixing the carrier with the toner and replenishing the developer, an absolutely needed amount of the toner increases, and therefore a storage capacity of the developer replenishing unit 6 needs to be increased or a replacement frequency of the developer replenishing unit 6 needs to be increased.

That is, when the trickle developing method having high efficiency in developer replenishment is used, it is better to discharge the developer at the right time, i.e., replace the developer corresponding to an increased amount relative to the replenished developer, than the discharge all the time. With this configuration, the discharge becomes stable relative to vibrations or the like, which enables suppression of an increase of the torque.

Figure 7:
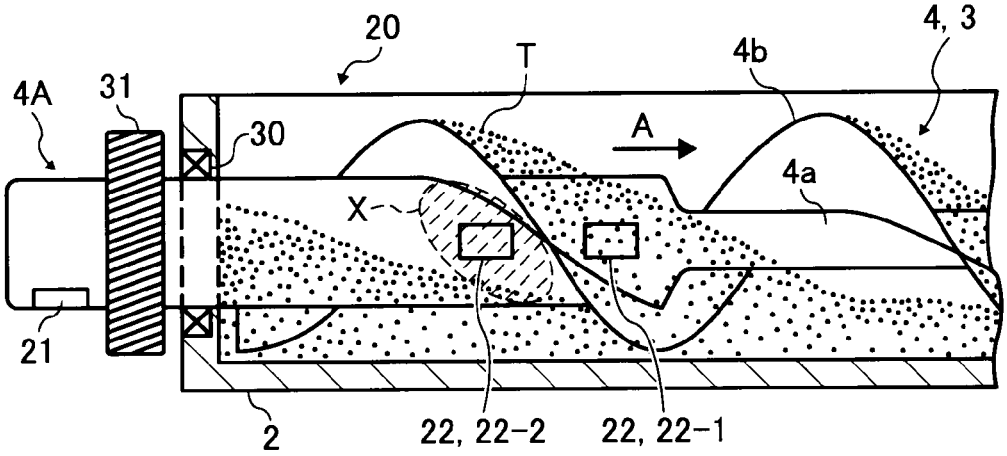
FIG. 7 is another example configuration of the surplus developer discharging mechanism.

An example configuration in which the positions of the collection port 22 and the screw 4 are appropriately regulated to obtain a discharge by the increased amount (an example configuration in which a collection port 22-2 described later is selected) is explained with reference to FIG. 7. FIG. 7 is a schematic diagram for explaining an example configuration of the shaft end 4A.

FIG. 7 depicts two example configurations in which the developer T is transferred in a direction A by the screw 4 (3). That is, a case that the collection port 22 of the surplus developer is set near a rear side (downstream side), designating the blade of the stirring screw as a boundary, as seen from the transfer direction A (hereinafter, the collection port on the downstream side is referred to as a collection port 22-1), and a case that the collection port 22 is set near a front side as seen from the transfer direction A (hereinafter, the collection port on the upstream side is referred to as the collection port 22-2). The discharge performance of the surplus developer discharging mechanism 20 changes according to a selection of these configurations.

A powder transfer operation by the screw blade is explained here. Because a rear face of the screw blade carries the developer away to the downstream side while forcing up the developer due to the rotation, the neighborhood of the shaft of the screw, which is near the rear face, is roughly covered with the developer. On the other hand, a front face of the screw blade (X in the drawing) has an action of suppressing of being covered with the developer from above, with the screw blade acting as a canopy. The example configuration of the embodiment uses the action of the screw blade for the discharge performance.

Figure 8A:
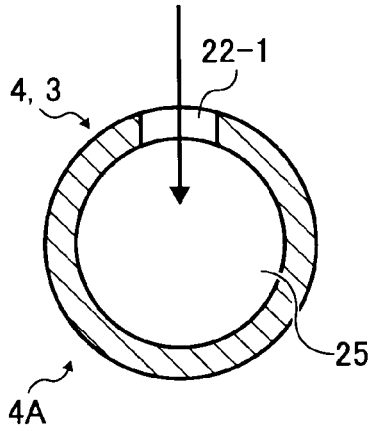
FIGS. 8A to 8D are cross sections of a shaft of the stirring and transferring unit.
Figure 8B:
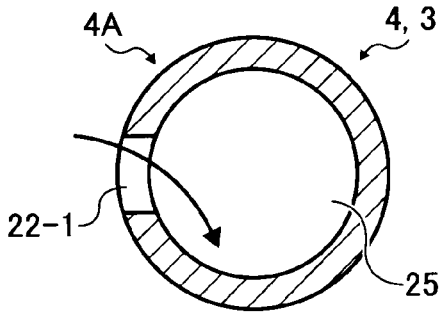

That is, when the collection port 22-1 in FIG. 7 is selected, the collection port 22-1 and the circumference thereof are covered with the developer T forced up by the screw blade 4*b* at all times. Therefore, the developer is allowed to flow in, when the collection port 22-1 is sideways during the rotation of the screw 4 as shown in FIGS. 8B and 8D, and further, the developer is also allowed to flow into the hollow portion 25 in a state open upward in which the collection port 22-1 is located at the top, as shown in a cross section of the hollow portion in FIG. 8A. As a result, this state is relatively close to the state where the developer is discharged all the time, regardless of increase or decrease of the developer in the developer container.

Figure 8C:
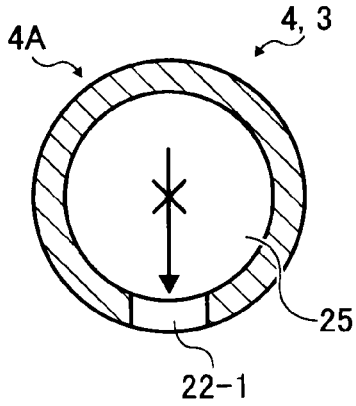
Figure 8D:
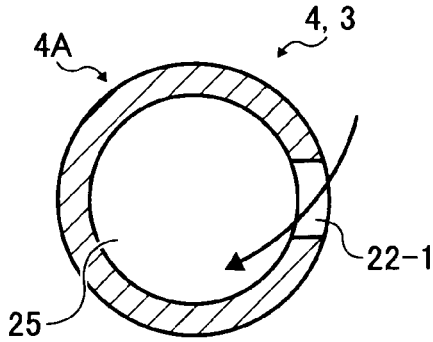

However, because the developer is discharged via the inner space of the rotating screw shaft, in a state where the collection port 22-1 is present at a position open downward as shown in FIG. 8C, the developer is present at the bottom of the developer container, and therefore the developer hardly flows in or flows backward, so that the developer is not discharged all the time.

Figure 9A:
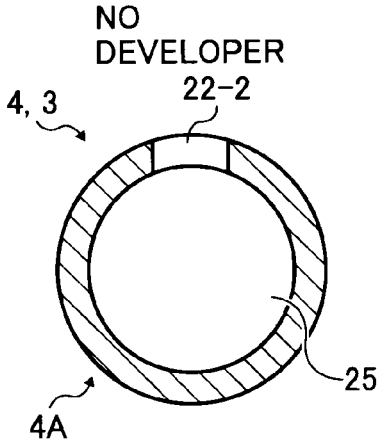
FIGS. 9A to 9D are cross sections of the shaft of the stirring and transferring unit.

On the other hand, in the case of a configuration in which the collection port is arranged at the position of the collection port 22-2 in FIG. 7, that is, near the front side of the screw blade 4*b*, the developer T is relatively not present, due to the action of the screw blade. Therefore, as shown in a cross section of the screw shaft in FIG. 9A, when the collection port 22-2 is open upward, inflow of the developer into the collection port is suppressed, and in a case that the collection port 22-2 is sideways as shown in FIGS. 9B and 9D, the developer flows in.

Figure 9B:
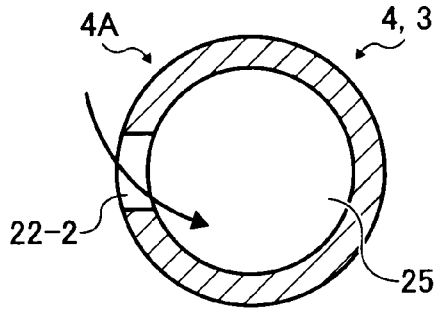
Figure 9C:
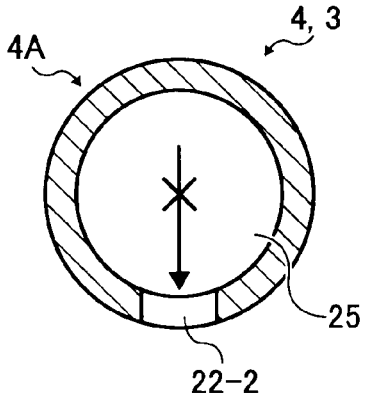
Figure 9D:
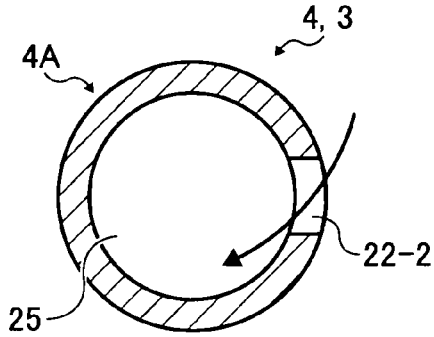

In a case that the collection port is arranged at the bottom as shown in FIG. 9C, as in the state in FIG. 8C, the developer hardly flows in or flows backward, and inflow in the case of the collection port being sideways as shown in FIGS. 9B and 9D determines the discharge amount of the surplus developer.

In the configuration in which the collection port 22-2 is selected, sensitivity relative to a filled amount of the developer in the developer container is improved as compared to the configuration in which the collection port 22-1 is selected. This is because when the amount of the developer in the developer container increases due to the replenishment of the new developer, an interface (draft line) of the developer, in which the screw 4 (3) is dipped, increases, and the screw 4 (3) is covered with the developer increasing from the bottom, even if the position of the collection port 22-2 is selected. As a result, even in the state where the collection port is close to the upward position shown in FIG. 9A, inflow of the developer occurs, and discharge of the developer at the right time can be performed with high sensitivity, corresponding to the increased amount of the developer.

The inflow of the developer also changes according to the fluidity of the developer. In this case, because the inflow depends on an opening area for collecting the developer, the opening area is adjusted as a parameter to control the discharge amount, thereby ensuring the stable discharge amount, without being affected by vibrations or the like.

Figure 10:
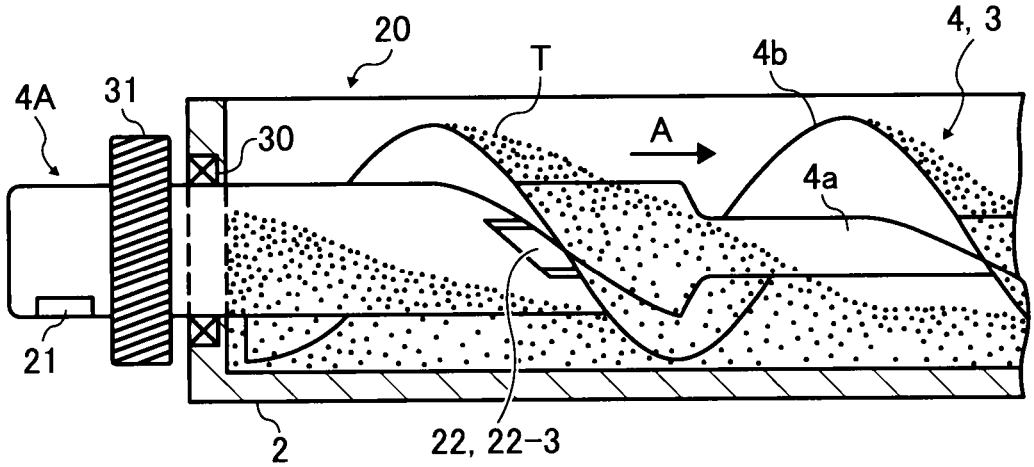
FIG. 10 is a modified example of the surplus developer discharging mechanism in which an opening position is changed.

A modified example of the surplus developer discharging mechanism 20 in which the opening position is changed is explained with reference to FIG. 10.

That is, in the surplus developer discharging mechanism 20, the collection port 22 (22-3), assuming that the developer T is transferred in the direction A by the screw 4 (3), is provided on a face of the rotation shaft 4*a* along a root of the protruding screw blade 4*b*, and the collection port 22-3 is formed in a slit form extending in a spiral direction. Accordingly, the canopy effect can be improved, and the inflow of the developer is regulated according to the position (rotation angle) of the collection port 22-3 relative to the interface of the developer, and the inflow changes according to the opening area of the collection port sunk under the interface. Therefore, the discharge amount can be ensured with high sensitivity.

As shown in a top view of the developing device in FIG. 1C, it is preferable to arrange the collection port 22 at a position where the developer in an amount as small as possible is stirred and transferred, among respective positions in a longitudinal direction of the respective screws, in the flow of the developer due to the rotation of the respective screws 3 and 4. For example, by setting the collection port 22 at a position of Y in FIG. 1C, which is the uppermost stream side in the transfer direction A of the developer or at a position of Z, which is the uppermost stream side in a transfer direction B of the developer, the surplus developer in a small amount, which is sequentially replaced, can be stably discharged, because the height of the developer is suppressed to be low near the collection port. In this case, the hollow portion extending to the discharge port 21 is provided inside the rotation shafts 4*a* and 3*a* of the respective screws 3 and 4.

Further, because the collection port 22 and the discharge port 21 are rotating always together with the screw, the opening is not blocked due to adhesion of the toner, and does not cause an increase of the torque.

As in the conventional example, if the discharge port is provided on a side wall of the developing device, a discharge container or a discharge route of the discharged developer is required on the outside thereof. For example, in a configuration of a train-of-four tandem color-copier, not only the distance between photosensitive drums becomes longer, but also the apparatus itself becomes larger.

When the discharge port is provided on the wall of the developing device facing the shaft end 4A of the screw, it can be prevented that the apparatus becomes large in a cross sectional direction, however, it becomes difficult to arrange the drive gear at the shaft end 4A on the discharge port side. Therefore, there is a restriction in the arrangement such that the discharge port needs to be arranged in a direction opposite to the drive gear of the screw. Accordingly, for example, when the discharge port and the discharge route are on the front face of the apparatus, a layout can be such that an access to other imaging units and supply from the front face of the image forming apparatus, which is required for maintenance, is blocked.

On the other hand, with the configuration according to the embodiment, there is no restriction in the relation between the discharge route and the drive gear, and the discharge route and the drive gear can be arranged in an optional same position. Particularly, as shown in the example configuration in FIG. 4, the drive gear and the discharge port can be arranged in the same direction on a rear face of the apparatus. Accordingly, it can be prevented that the apparatus becomes large, and the access from the front face is not blocked.

The developing device 1 can be applied to an image forming unit (including the latent image carrier, the charger, an exposure unit, the developing device 1, the transfer unit, and a fuser) in a general electrophotographic image forming apparatus such as a copier, a printer, a facsimile machine, and a multifunction product having functions of these.

Therefore, by adopting a configuration in which discharge is regulated relative to the discharge port 21 for discharging the surplus developer to control the surplus developer, the discharge amount can be set to a reasonable amount, and the developer volume in a developing unit can be maintained properly. This is explained with reference to FIGS. 11 to 13.

Figure 11:
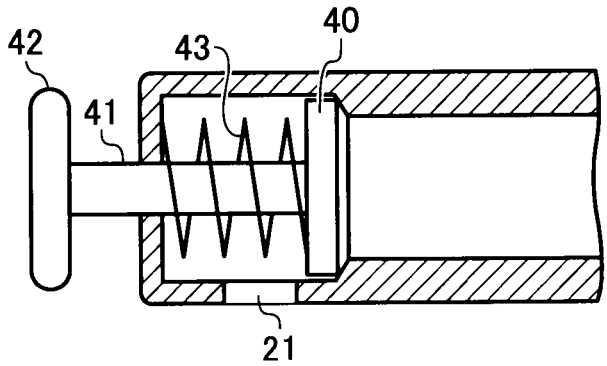
FIGS. 11 and 12 are schematic diagrams for explaining discharge regulation and control state of developer.

A regulating member 40 that regulates the discharge is provided at the discharge port 21 in FIG. 11. The regulating member 40 is integrally formed with a shaft 41 and an actuator 42, and maintains a state shown in FIG. 11 by a spring 43. In this state, discharge of the surplus developer is regulated so that the developer is not discharged from the discharge port 21. This state can be switched to a deregulation state by moving the actuator 42 in a leftward direction in the drawing by a separate unit described later to compress the spring, and the surplus developer can be discharged from the discharge port.

Figure 12:
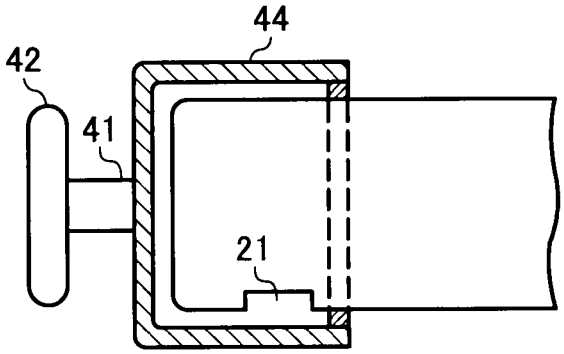

In the configuration shown in FIG. 12, a cover 44 for covering the discharge port 21 is integrally formed with the shaft 41 and the actuator 42. The discharge port 21 is released from the cover 44 by moving the actuator 42 in the leftward direction in the drawing by the separate unit, and the surplus developer can be discharged from the discharge port.

Figure 13:
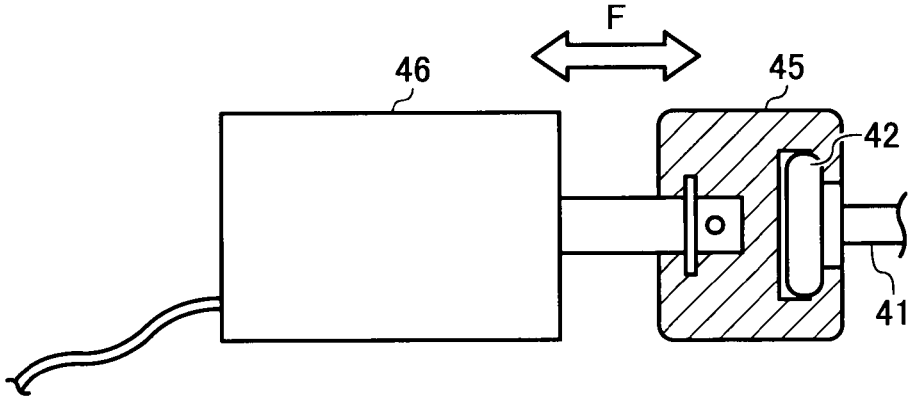
FIG. 13 is a schematic diagram for explaining an example of a configuration to drive a regulating member for developer discharge.

FIG. 13 is a schematic diagram for explaining an example of a configuration to drive the actuator 42, and for example, the actuator 42 is moved in a horizontal direction shown by arrow F by driving means such as a solenoid 46, thereby changing the state of the regulating member 40 and the regulating cover 44 at the discharge port 21 shown in FIGS. 11 and 12.

In the discharge control, an amount corresponding to the replenishment-controlled amount from the developer replenishing unit 6 needs only to be discharged as a step of replenishing the new developer, for example explained above with reference to FIG. 1, because it is an object of the discharge control to keep the developer volume in the developing unit approximately constant. Therefore, by driving the actuator for the time corresponding to the amount replenished from the replenishing opening 7 to the developing device 1, the discharge amount can be made appropriate.

The collection port 22 and the discharge port 21 are rotating all the time together with the screw. Therefore, the gravity relative to the developer near the discharge port changes all the time, and the toner is not accumulated in the opening, thereby preventing the opening from being blocked due to adhesion of the toner.

Further, in the transfer unit from the collection port 22 to the discharge port 21, the developer is transferred in one direction. Therefore, the developer need not be transferred backward, and therefore the torque is not increased. For example, with the configuration according to the embodiment in which the discharge of the surplus developer is regulated, the developer is only filled in the screw hollow portion even in the regulation state, and therefore there is no influence of the screw to the rotation torque, thereby not causing an increase of the torque.

According to the embodiment, particularly as shown in FIG. 4, the drive gear 31 is arranged to cover the hollow portion for discharging the surplus developer, which has a large advantage in that a space required for discharge need not be set separately, thereby preventing the developing device from becoming large.

Figure 14:
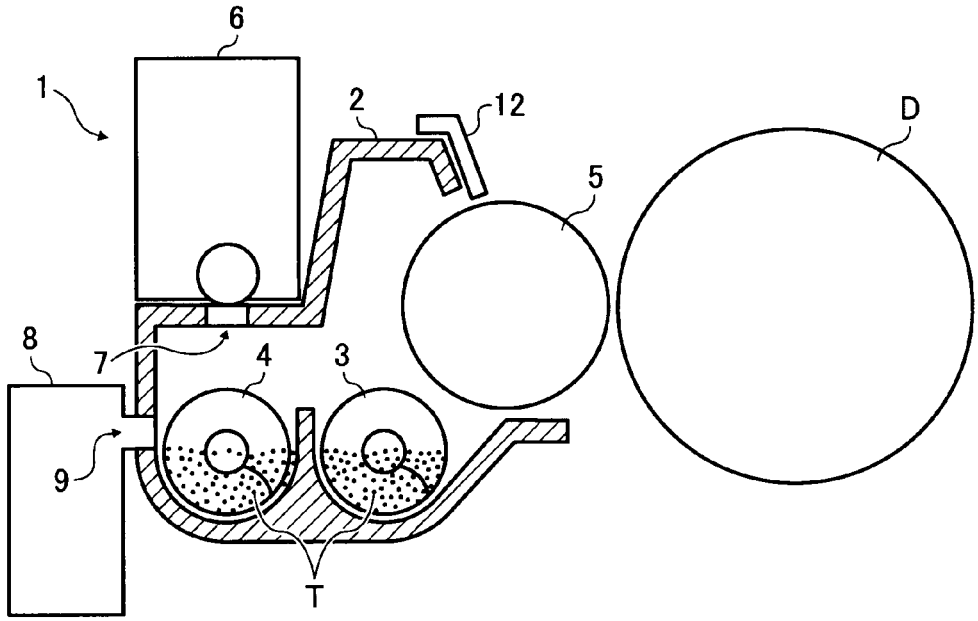
FIG. 14 is another example of the image forming unit shown in FIG. 1A.

FIG. 14 depicts the developing device and the photosensitive drum of the image forming apparatus. Like reference numerals refer to like components as in FIGS. 1A to 1C.

The surface of the rotatable photosensitive drum D is uniformly charged by the charger (not shown), and image data corresponding to a document content read by the image reader (not shown) or information transmitted from a host PC is written thereon by laser beams from the laser writing unit (not shown), thereby forming an electrostatic latent image on the surface of the photosensitive drum D.

The developing device 1 uniformly supplies the toner to the photosensitive drum D to realize visualization of the electrostatic latent image. For this purpose, the developing device 1 includes the rotatable developing sleeve (developing roller) 5 arranged and set opposite to the photosensitive drum D and the magnetic body having a magnetic pole (not shown) arranged therein.

The magnetic body is required for holding the developer on the developing sleeve 5, and the doctor blade 12 regulates the developer amount to be held on the developing sleeve to a proper amount.

The doctor blade 12 is normally formed in a plate shape of stainless steel or the like, and is set to be away from the surface of the developing sleeve 5 by about 0.2 millimeter to 1.2 millimeters, so that a developer layer is formed on the developing sleeve 5 in a uniform thin layer to supply the developer uniformly to the electrostatic latent image on the photosensitive drum D.

An operation of the developer T in the developer container 2 is explained with reference to a schematic diagram of FIG. 13 for explaining a conventional example.

The developer T is in a state of being filled in the developing device 1. The unit that supplies the developer to the vicinity of the developing sleeve 5 and the doctor blade 12 can be, for example, in a paddle shape capable of supplying the developer by pushing up or splashing. In this example, however, the developer supply unit has a screw shape also having a transfer function in a horizontal direction.

The screw 4 that stirs and transfers the developer T in a direction opposite to the transfer direction of the screw 3 having the function of supplying the developer to the developing sleeve 5 while stirring and transferring the developer T is rotatably arranged, to circulate the developer T in the developer container 2.

As a process of replenishing the new developer, the developer in an appropriate amount is replenished from the replenishing opening 7 to the developing device 1 by the developer replenishing unit 6, relative to the developer having used for development, with a replenishment amount being controlled. A discharge opening 9 for discharging the surplus developer T is separately arranged. The surplus developer is directly collected in the collecting container 8.

Figure 15:
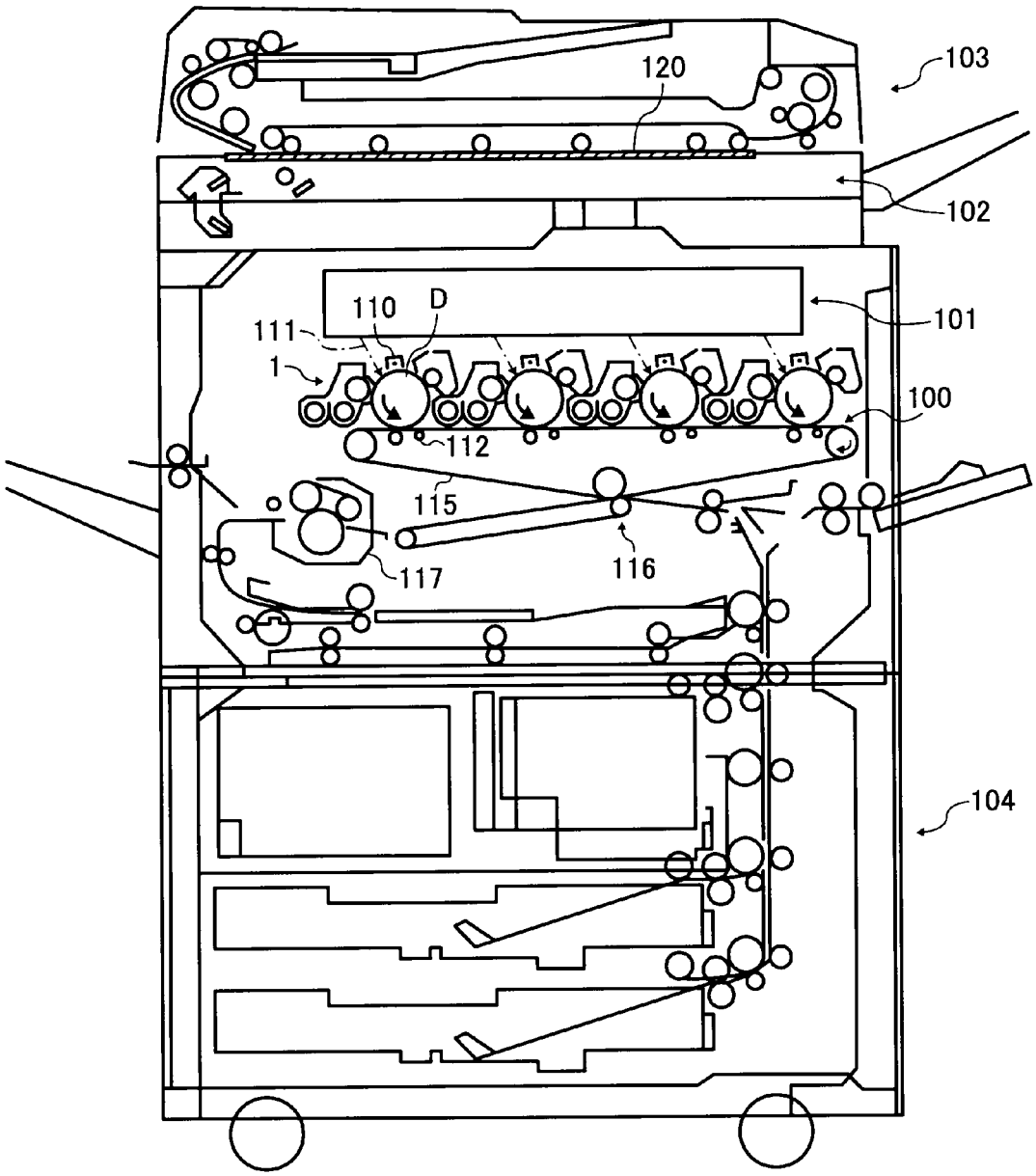
FIG. 15 is a schematic diagram of the electrophotographic image forming apparatus.

FIG. 15 is a schematic diagram of the image forming apparatus. The image forming apparatus is a full-color image forming apparatus, and includes an image forming unit 100, a write optical system 101, a read optical system 102, an automatic sheet feeder 103, and a sheet feeder 104.

The image forming unit 100 includes the photosensitive drum D, a charger 110 arranged on the peripheral face thereof, an exposure unit 111, the developing device 1, a primary transfer unit 112, an intermediate transfer belt 115, a secondary transfer unit 116, and a fuser 117. These components are arranged for each color toner.

A document supplied onto a contact glass 120 by the automatic sheet feeder 103 is read by the read optical system 102. The read image data is photoelectrically exchanged and subjected to image processing by an image processor. The image data is irradiated as laser beams onto the respective photosensitive drums D from the write optical system 101 to form an electrostatic latent image. The electrostatic latent image is turned to a visible image by the developer supplied from the developing device 1, and the visible image is sequentially superposed on the intermediate transfer belt 115 and primarily transferred.

The toner image superposed on the intermediate transfer belt 115 is transferred onto a recording sheet fed from the sheet feeder 104 in the secondary transfer unit 116, fixed in the fuser 117, and discharged to the outside.

Figure 16:
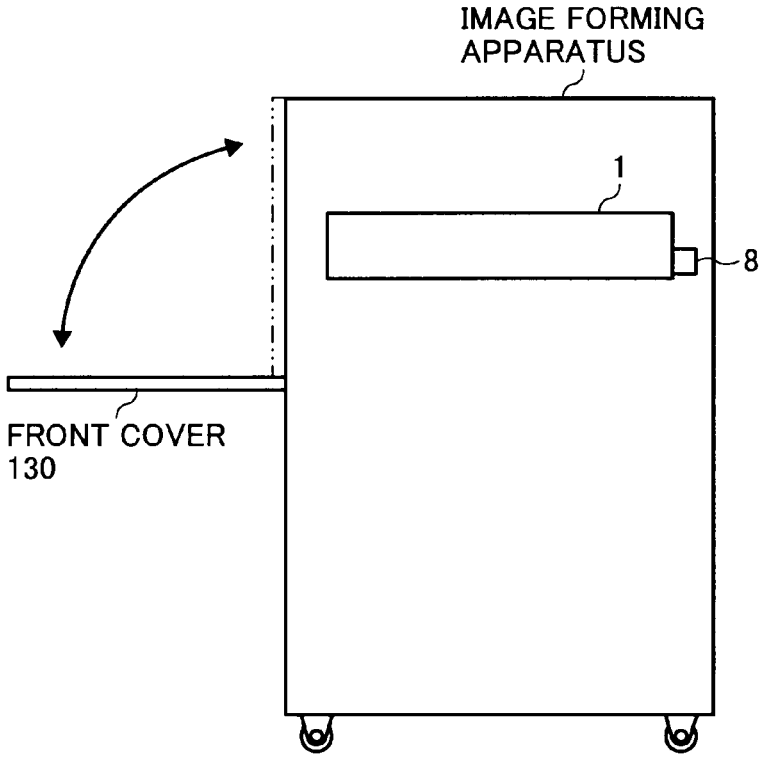
FIG. 16 is a side view of the electrophotographic image forming apparatus.

FIG. 16 is a side view of the image forming apparatus. In FIG. 16, the left side on the page is the front face, and the right side is the rear face. A front cover 130 is openably provided on the front face for accessing the developing device 1 and the collecting container 8 at the time of maintenance.

Figure 17:
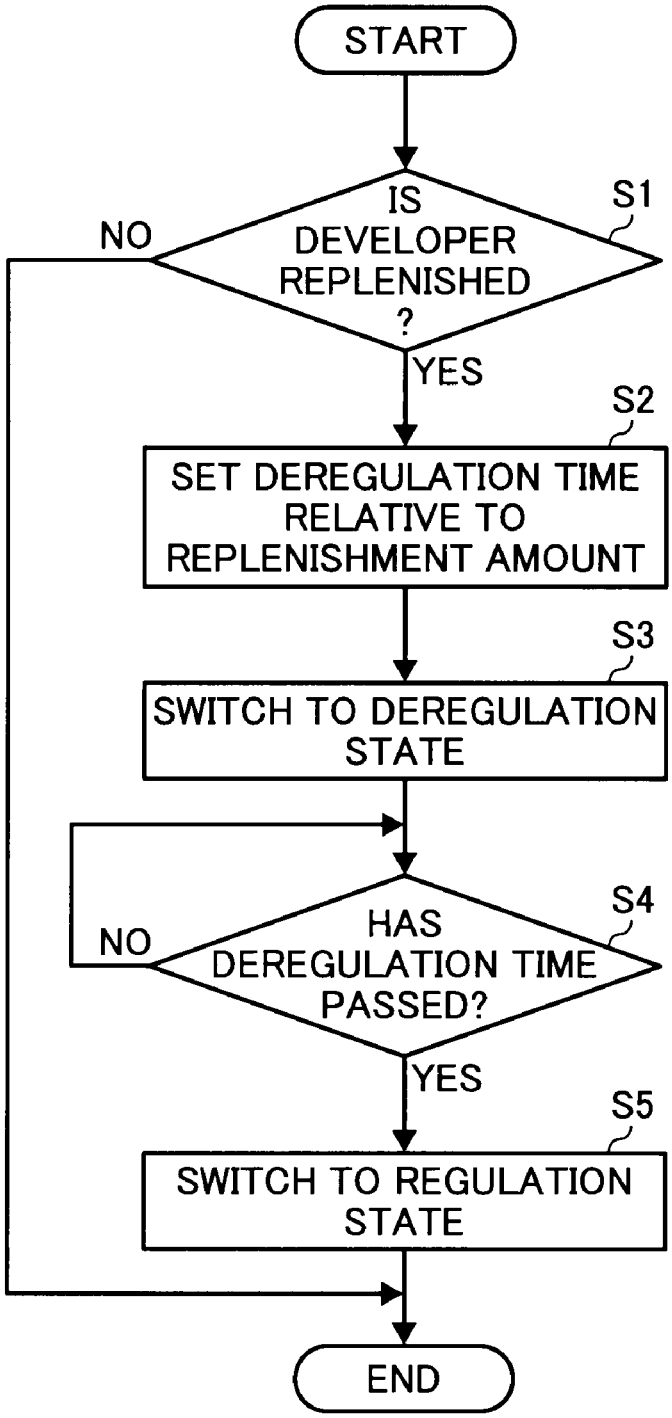
FIG. 17 is a flowchart of control of the regulating member.

FIG. 17 is a flowchart of control of the regulating member 40. When the developer is replenished (step S1), a deregulation time relative to the replenishment amount is set (step S2). Therefore, the regulating member 40 is switched to the deregulation state (step S3). When the deregulation state continues until the deregulation time (step S4), the regulating member 40 is switched again to the regulation state (step S5). Thus, the regulation is released for time duration preset relative to the replenishment amount of the developer to open the discharge port.

Figure 18A:
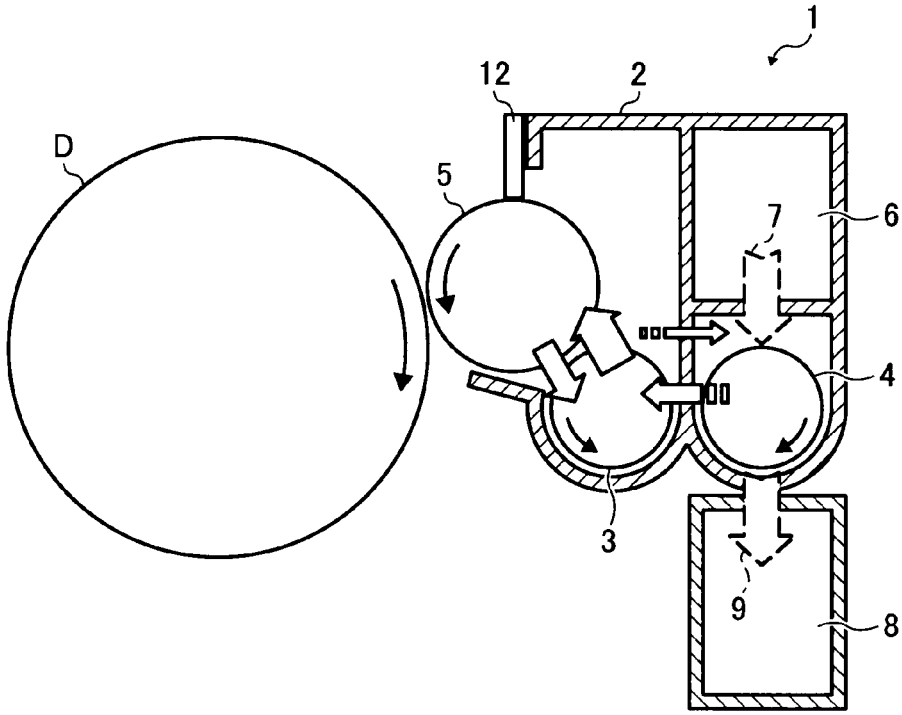
FIG. 18A is a schematic diagram of an image forming unit in an electrophotographic image forming apparatus including a developing device according to another embodiment of the present invention.
Figure 18B:
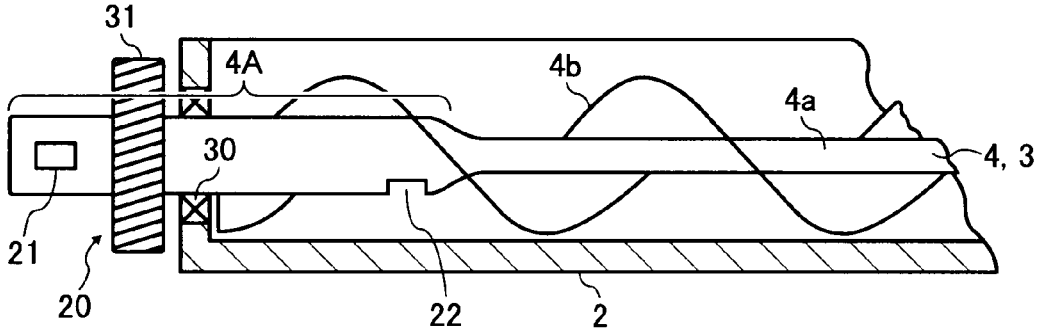
FIG. 18B is a longitudinal sectional view of a developer container.
Figure 18C:
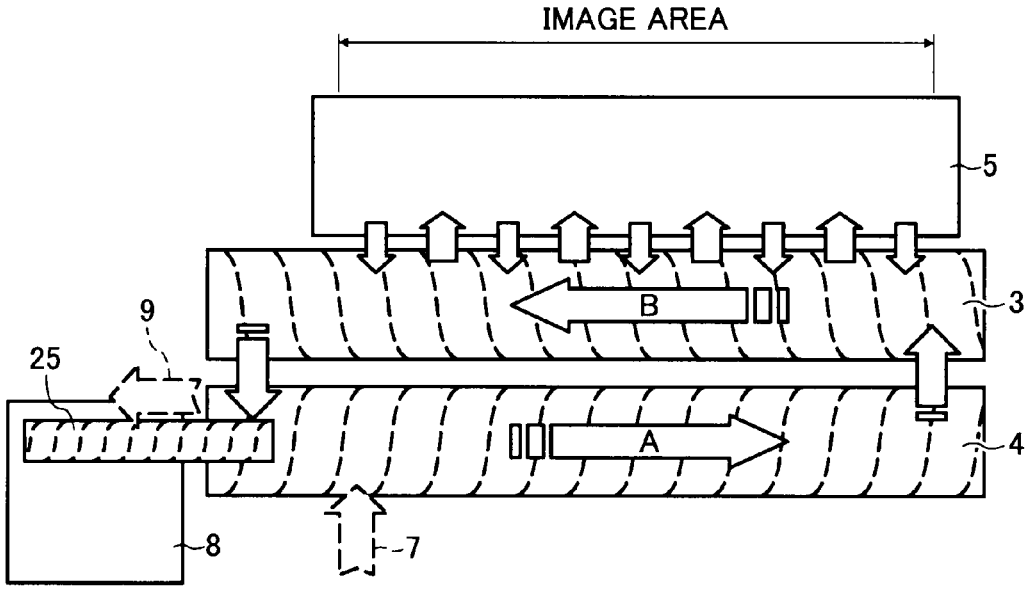
FIG. 18C is a cross sectional view of the developer container.

FIG. 18A is a schematic diagram of an image forming unit in an electrophotographic image forming apparatus including the developing device 1 and the photosensitive drum D according to another embodiment of the present invention. FIGS. 18B and 18C are a longitudinal sectional view and a cross sectional view of the developer container 2.

The surface of the rotatable photosensitive drum D is uniformly charged by the charger (not shown), and image data corresponding to a document content read by the image reader (not shown) or image data transmitted from the host PC is written thereon by laser beams from the laser writing unit (not shown). Thus, an electrostatic latent image is formed on the surface of the photosensitive drum D.

The developing device 1 uniformly supplies the toner to the photosensitive drum D to realize visualization of the electrostatic latent image. The developing device 1 includes the developer container 2 that contains the developer T including the toner and the carrier, the developer supply unit (stirring and transferring unit) 3 arranged in the developer container 2 and rotates to supply the developer to the developing roller 5, the screw 4 as the stirring and transferring unit, arranged in the developer container 2 and rotates for stirring, circulating, and transferring the developer, the developing roller (developer carrier) 5 arranged opposite to the latent image carrier via the opening 2*a* provided in the developer container 2 and rotatably supported, the developer replenishing unit 6 (the toner cartridge 6*a* and the replenishing roller 6*b*) that additionally replenishes the new developer including the carrier to the developer container 2 via the replenishing opening 7 provided in the developer container, and the surplus developer discharging mechanism 20 provided for discharging the surplus developer to the outside of the developer container.

The developing roller 5 is formed of the rotatable developing sleeve 5*a* arranged and set opposite to the peripheral face of the photosensitive drum D and the magnetic body having the magnetic pole (not shown) fixedly arranged in the developing sleeve 5*a*. The magnetic body in the developing roller 5 is required for holding the developer on the surface of the developing sleeve 5*a*, and the doctor blade 12 regulates the developer amount to be held on the surface of the developing sleeve to a proper amount. The doctor blade 12 is normally formed in a plate shape of stainless steel or the like, and is set to be away from the surface of the developing sleeve by about 0.2 millimeter to 1.2 millimeters, so that the developer layer is formed on the developing sleeve 5*a* in a uniform thin layer to supply the developer uniformly to the electrostatic latent image on the photosensitive drum D.

The screw (stirring and transferring unit) 3 includes the rotation shaft 3*a* rotatably and axially supported by the developer container 2 and rotated by the driving source, and the screw blade 3*b* spirally provided in a protruding condition on the outer circumference of the rotation shaft 3*a*.

The screw (stirring and transferring unit) 4 includes the rotation shaft 4*a* rotatably and axially supported by the developer container 2 and rotated by the driving source, and the screw blade 4*b* spirally provided in a protruding condition on the outer circumference of the rotation shaft 4*a*.

A salient feature of this embodiment is that the surplus developer discharging mechanism 20 is provided on the rotation shaft 3*a* or the rotation shaft 4*a* of the screw (stirring and transferring unit) 3 or 4. In this embodiment, an example configuration in which the surplus developer discharging mechanism 20 is provided on the rotation shaft 4*a* of the screw 4 is mainly explained.

The developer T is in a state of being filled in the developer container 2 in a predetermined amount. The developer supply unit 3 that supplies the developer to the vicinity of the developing sleeve 5*a* and the doctor blade 12 can be, for example, in a paddle shape capable of supplying the developer by pushing up or splashing. In this example, however, the developer supply unit 3 has the screw shape also having the transfer function in a horizontal direction.

The screw 4 stirs and transfers the developer T in a direction opposite to the transfer direction of the screw 3 having the function of supplying the developer T to the developing roller 5 while stirring and transferring the developer T. Both the screws 3 and 4 are rotatably arranged, and the developer T stirred and transferred by the screws 3 and 4 is moved and circulated in directions shown by arrows A and B in the developer container 2.

As a process of replenishing the new developer into the developer container, the developer in an appropriate amount is replenished from the replenishing opening 7 to the developer container 2 by the developer replenishing unit 6, with a replenishment amount being controlled. The discharge port 21 for discharging the developer T, which becomes surplus due to the replenishment of the new developer, is arranged outside of the developer container, at the shaft end 4A of the rotation shaft 4*a* of the screw 4. The surplus developer discharged from the discharge port 21 is directly collected in the collecting container 8, or is carried to the collecting container 8 by a separate transfer unit (not shown) and collected therein.

Figure 19:
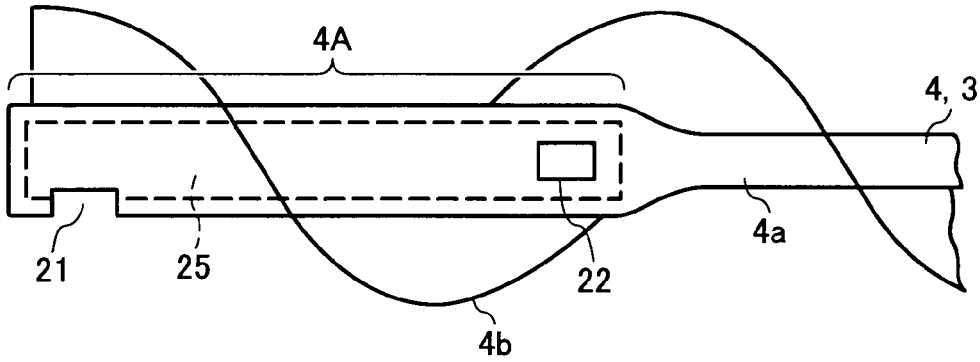
FIG. 19 is an example configuration of a surplus developer discharging mechanism shown in FIG. 18B.

FIG. 19 is an external view of an example configuration of the surplus developer discharging mechanism 20 according to this embodiment. The surplus developer discharging mechanism 20 is provided at the shaft end 4A of the rotation shaft 4*a* of the screw (stirring and transferring unit) 4.

The surplus developer discharging mechanism 20 includes the hollow portion 25 provided in a part (the shaft end 4A) of the rotation shaft 4*a* of the screw 4, and the hollow portion 25 constitutes the discharge route of the surplus developer. The rotation shaft 4*a* includes the collection port 22 for collecting the surplus developer in the developer container 2 in the hollow portion 25, and the discharge port 21 for discharging the developer collected in the hollow portion to the outside of the developer container. In this example, the shaft end 4A of the rotation shaft 4*a* is formed to have a large diameter, and the hollow portion 25 is provided inside the large-diameter shaft end 4A, and the discharge port 21 is provided at the shaft end 4A of the rotation shaft 4*a* protruding to the outside of the developer container. The collection port 22 is positioned inside of the developer container.

Figure 20:
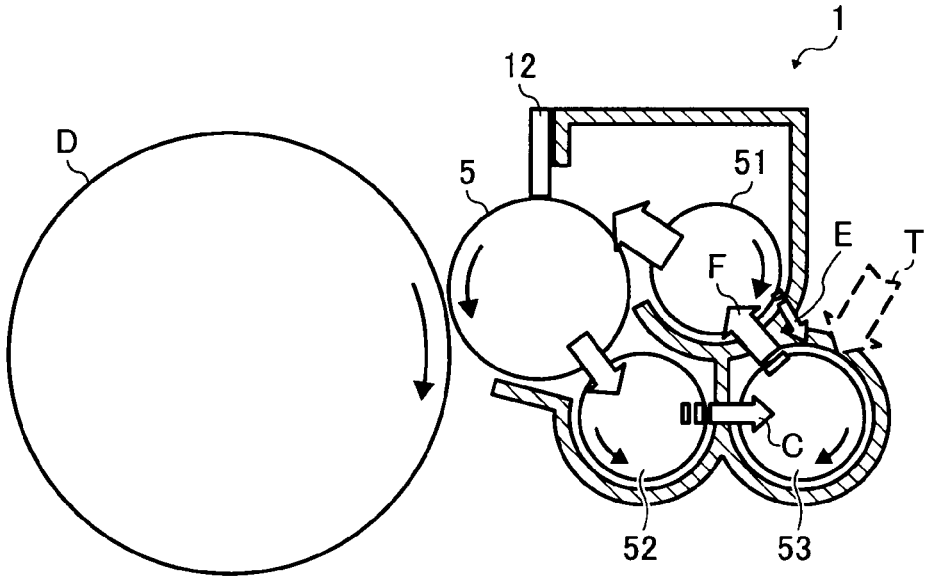
FIG. 20 is another example of the image forming unit shown in FIG. 18A.
Figure 21:
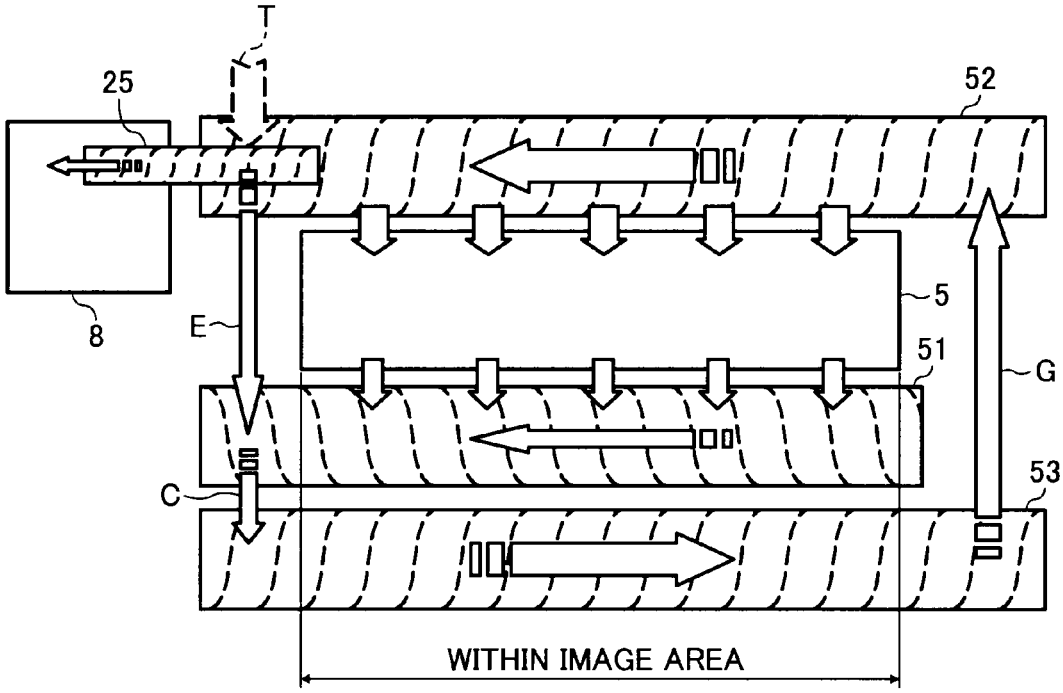
FIG. 21 is a schematic diagram for explaining movement of developer in the developing device.

Another embodiment in which the surplus developer discharging mechanism is installed in the developing device having three developer transfer units is explained with reference to FIGS. 20 and 21. In FIG. 20, the photosensitive drum D and the developing sleeve 5 respectively have the same function as those shown in FIG. 18, and therefore explanations thereof are omitted. The movement of the developer in the developing device 1 is briefly explained.

A feed screw 51 also having a transfer function in the horizontal direction is arranged near the developing sleeve 5 and the doctor blade 12, which are used in a developer regulating process, as a unit that supplies the developer, and a collection screw 52 also having a transfer function in an axial direction is arranged as a unit that collects the developer separated from the developing sleeve 5.

In FIG. 20, the developer transfer directions by the feed screw 51 and the collection screw 52 are in the axial same direction shown by respective arrows, and a stirring and transfer screw 53 that transfers the developer in a direction opposite to these transfer directions is arranged. The screws as these transfer units are positioned in separate sections, and a continuous opening is provided at a shaft end to cause a flow shown by arrows C, F, and E, respectively, as the flow of the developer, so that developer circulation in a constant direction is realized in the developing device 1.

A different point from the conventional general developing device, for example, the developing device shown in FIGS. 18A to 18C, is that screws for feeding and collecting are independent from each other. The feed and collection flows of the developer relative to the developing sleeve 5 shown in FIGS. 18A and 18C are performed only the screw 3, which is largely different from this embodiment.

Therefore, in the developing device including three transfer units, transfer units for feeding and collecting are made separate, and additionally replenished toner is sufficiently stirred in the stirring and transferring unit, and the sufficiently stirred developer can be supplied to the developing sleeve 5, thereby obtaining stable image density, as compared to the conventional developing device in which the developer having used for development is directly supplied to the developing sleeve again, thereby making the toner density nonuniform.

Further, a relation between the flow of the developer by the three developer transfer units and the surplus developer discharging mechanism is explained in detail.

Transfer of the developer to the downstream of the collection screw 52 and the upstream of the stirring and transfer screw 53 of C at respective portions of the continuous openings C, G, and E that connect independent sections of respective screws in the discharge port 21 is horizontal transfer, as shown in FIG. 9.

Further, transfer of the developer from the downstream of the stirring and transfer screw 53 to the upstream of the feed screw 51 of D is in a form of lifting the developer upward against the gravity, and the developer is lifted by a pressure of the developer in the section of the stirring and transfer screw 53.

Transfer of the developer from the downstream of the feed screw 51 to the upstream of the stirring and transfer screw 53 of E is free drop downward.

The amount and the height of the developer in the sections where each screw as the transfer unit is arranged are explained below.

As the amount of the developer input to the collection screw 52, a constant amount of developer regulated to the constant amount by constant rotation of the developing sleeve 5 and the doctor blade 12 becomes a collected input amount. The toner is consumed between the developing sleeve 5 and the photosensitive drum D accompanying the image formation. However, the developer becomes substantially constant with about 1 to 3% of the developer having passed through the doctor blade and several percents of the whole developer, with a small amount of the developer being present on the upstream side of the collection screw 52, and the developer in an amount almost covering the half of the screw being present on the downstream side thereof.

With the stirring and transfer screw 53, the developer having a low toner density transferred from the collection screw 52, and the developer that has not been supplied to the doctor blade 12 from the feed screw 51 are transferred to the upstream of the stirring and transfer screw 53, to be filled in a height of about 80% of the screw height, and transferred. On the downstream side thereof, a large amount of developer is compressed for lifting the developer to the feed screw 51.

The upstream side of the feed screw 51 is in such a state that the space is filled with the lifted developer. However, to the most downstream side thereof, the developer in an amount as small as about one third of the screw height is transferred, because the amount sequentially supplied to the developing sleeve is decreasing during being transferred to the downstream side.

As explained above, therefore, the surplus developer discharging mechanism can achieve the discharge function accurately at a portion where the developer flows with a low height. If this is adopted for the developing device having the three transfer units, it is most desirable to install the surplus developer discharging mechanism on the most downstream side of the feed screw 51. Further, the surplus developer can be discharged quite accurately, because there is a portion where the developer is filled to a height lower than the screw, which is the transfer unit in the conventional developing device.

According to this embodiment, because the collection port and the discharge port are rotating all the time together with the screw, the opening is not blocked due to the adhered toner, and an increase of the torque can be prevented accordingly.

As in the conventional example, if the discharge port is provided on the side wall of the developer container 2, a discharge container or a discharge route of the discharged developer is required on the outside thereof. For example, in a configuration of a train-of-four tandem color-copier, not only the distance between photosensitive drums becomes longer, but also the apparatus itself becomes larger.

When the discharge port is provided on the wall of the developing device facing the shaft end of the screw, it can be prevented that the apparatus becomes large in a cross sectional direction, however, it becomes difficult to arrange the drive gear at the shaft end on the discharge port side. Therefore, there is a restriction in the arrangement such that the discharge port needs to be arranged in a direction opposite to the drive gear of the screw. Accordingly, for example, when the discharge port and the discharge route are on the front face of the apparatus, a layout can be such that an access to other imaging units and supply from the front face of the image forming apparatus, which is required for maintenance, is blocked.

On the other hand, with the configuration according to the embodiments, there is no restriction in the relation between the discharge route and the drive gear, and the discharge route and the drive gear can be arranged in an optional same position. Particularly, as shown in the example configuration in FIG. 6, the drive gear and the discharge port can be arranged in the same direction on a rear face of the apparatus. Accordingly, it can be prevented that the apparatus becomes large, and the access from the front face is not blocked.

The developing device described above can be applied to an image forming unit (including the latent image carrier, the charger, the exposure unit, the developing device, the transfer unit, and the fuser) in a general electrophotographic image forming apparatus such as a copier, a printer, a facsimile machine, and a multifunction product including these.

As set forth hereinabove, according to an embodiment of the present invention, the collection port and the discharge port are set on the shaft of the stirring and transferring unit (screw) rotating all the time. Therefore, the toner and the developer adhering around the collection port and the discharge port are shook off due to the action of a centrifugal force and the gravity, and the collection port and the discharge port can be prevented from being blocked by the toner adhesion. Further, a backward flow can be suppressed by the transfer unit to the collection port and the discharge port, which enables stable discharge of the small amount of developer.

Moreover, because the discharge port and the drive unit of the screw are arranged at the same shaft end of the screw on the rear face of the image forming apparatus, the apparatus can be made small without blocking the access to other functions from the front face of the image forming apparatus. Furthermore, design flexibility can be considerably increased.

The unit that discharges and transfers the surplus developer is provided in the hollow portion in the screw shaft, to form a transfer unit having a spirally protruding shape or a tapered discharge route, which realizes a simple discharge configuration.

The collection port provided on the screw shaft is set on the upstream side of the screw blade, which enables control of the discharge amount of the surplus developer.

The surplus developer can be discharged efficiently from the developer container by arranging the collection port on the upstream in the longitudinal transfer axial direction of the screw.

Stable discharge of the developer enables to maintain stable developer density, and as a result, stable image density, and to prevent problems such as background stain over a long period.

By employing the surplus developer discharging mechanism in a developing device having three developer transfer units that can obtain image quality stability, in which density unevenness or the like does not occur in an output image, even when images having a high area ratio are continuously printed out, more accurate discharge becomes possible. The developing device having three developer transfer units includes screws respectively having a function of feed, collection, and transfer of the developer, and has a configuration such that the feeding and collecting functions are separated from each other so that the developer having a low toner density ratio after obtaining an image having a high area ratio is not used for the next development, thereby solving a problem such as density unevenness, which is likely to occur in the case of using a general configuration including two developer transfer screws.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A developing device, comprising:

a container that contains developer including toner and carrier, and includes a first opening and a second opening;

a developer carrier that is rotatably supported to face an image carrier via the first opening of the container, and carries the developer;

a stirring and transferring unit that is located in the container to mix and stir the toner and the carrier, and circulates the developer in the container, the stirring and transferring unit including a rotation shaft and a screw blade extending from the rotation shaft;

a replenishing unit that replenishes the container with developer from the second opening;

a discharging mechanism that discharges surplus developer out of the container, and is located on a shaft end of the rotation shaft of the stirring and transferring unit, the shaft end of the rotation shaft of the stirring and transferring unit including a collection port to collect the developer in the container, a discharge port positioned outside of the container to discharge the developer that is collected in the rotation shaft, and a hollow portion inside the shaft end and extending from the collection port to the discharge port to transport the developer from the collection port to the discharge port, and the hollow portion is tapered such that a diameter of the hollow portion at the discharge port is larger than a diameter of the hollow portion at the collection port; and a bearing that is disposed between the collection port and the discharge port.

2. The developing device according to claim 1, wherein the discharging mechanism includes, in the hollow portion, a discharging member that discharges the surplus developer.

3. The developing device according to claim 2, wherein the discharging member is a spiral protrusion to transfer the surplus developer.

4. The developing device according to claim 1, further comprising:

a regulating member that operates in any one of a regulation state and a deregulation state, the regulating member regulating an amount of developer to be discharged from the discharge port in the regulation state, and allowing a greater amount of developer than the developer discharged in the regulation state to be discharged from the discharge port in the deregulation state; and a controller that controls the regulating member to any one of the deregulation state and the regulation state.

5. The developing device according to claim 1, wherein an entire opening of the collection port is located near an upstream side of the screw blade in a developer transfer direction.

6. An image forming apparatus, comprising:

the developing device according to claim 1.

7. The image forming apparatus according to claim 6, wherein a discharge opening and a driving unit that drives a screw are arranged on a rear side of the image forming apparatus.

8. The developing device according to claim 1, further comprising:

a drive gear positioned on the shaft end between the bearing and the discharge port, and the drive gear is driven to rotate the stirring and transferring unit.

9. The developing device according to claim 1, wherein an outer diameter of the shaft end of the rotation shaft is larger than a diameter of a rest of the rotation shaft where the shaft end is not located.

10. A developing device, comprising:

a container that contains developer including toner and carrier, and includes a first opening, a second opening, a third opening, and a fourth opening;

a developer carrier that is rotatably supported to face an image carrier via the first opening of the container, and carries the developer;

a developer supply unit that supplies the developer to the developer carrier, the developer supply unit including a rotation shaft and a screw blade extending from the rotation shaft;

a stirring and transferring unit that is located in the container to mix and stir the toner and the carrier, and circulates the developer in the container;

a developer collecting unit that collects developer separating from the developer carrier after a necessary amount of developer is supplied to the image carrier from the developer regulated on the developer carrier;

a replenishing unit that replenishes the container with new developer containing carrier from the second opening;

a discharging mechanism that discharges surplus developer out of the container, and is located on a shaft end of the rotation shaft of the developer supply unit, and the shaft end of the discharging mechanism includes a collection port to collect the surplus developer in the container, a discharge port to discharge the surplus developer collected in the rotation shaft, and a hollow portion extending from the collection port to the discharge port to transport the developer from the collection port to the discharge port, and the hollow portion is tapered such that a diameter of the hollow portion at the discharge port is larger than a diameter of the hollow portion at the collection port; and a bearing that is disposed between the collection port and the discharge port, wherein the third opening allows a circulation path of the stirring and transferring unit to communicate with the developer supply unit, and the fourth opening allows the circulation path to communicate with the developer collecting unit.

11. The developing device according to claim 10, wherein the discharging mechanism includes, in the hollow portion, a discharging member that discharges the surplus developer.

12. The developing device according to claim 11, wherein the discharging member is a spiral protrusion to transfer the surplus developer.

13. The developing device according to claim 10, further comprising:

a regulating member that operates in any one of a regulation state and a deregulation state, the regulating member regulating an amount of developer to be discharged from the discharge port in the regulation state, and allowing a greater amount of developer than the developer discharged in the regulation state to be discharged from the discharge port in the deregulation state; and a controller that controls the regulating member to any one of the deregulation state and the regulation state.

14. The developing device according to claim 10, wherein an entire opening of the collection port is located near an upstream side of the screw blade in a developer transfer direction.

15. An image forming apparatus, comprising:

the developing device according to claim 10.

16. The image forming apparatus according to claim 15, wherein a discharge opening and a driving unit that drives a screw are arranged on a rear side of the image forming apparatus.

17. The developing device according to claim 10, further comprising:

a drive gear positioned on the shaft end between the bearing and the discharge port, and the drive gear is driven to rotate the developer supply unit.

18. The developing device according to claim 10, wherein an outer diameter of the shaft end of the rotation shaft is larger than a diameter of a rest of the rotation shaft where the shaft end is not located.

* * * * *